US008654501B2

(12) United States Patent
Gentsch

(10) Patent No.: US 8,654,501 B2
(45) Date of Patent: Feb. 18, 2014

(54) LOW-, MEDIUM-, OR HIGH-VOLTAGE SWITCHING DEVICE WITH CHEMICAL CHARGE MEANS

(75) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 33 days.

(21) Appl. No.: 13/422,553

(22) Filed: Mar. 16, 2012

(65) Prior Publication Data

US 2012/0199451 A1 Aug. 9, 2012

Related U.S. Application Data

(63) Continuation of application No. PCT/EP2010/005727, filed on Sep. 17, 2010.

(30) Foreign Application Priority Data

Sep. 17, 2009 (EP) ..... 09011839

(51) Int. Cl.
*H01H 39/00* (2006.01)

(52) U.S. Cl.
USPC ..... 361/247

(58) Field of Classification Search
USPC ..... 361/247
See application file for complete search history.

(56) References Cited

U.S. PATENT DOCUMENTS

| | | | | |
|---|---|---|---|---|
| 3,532,843 | A | 10/1970 | Pucher | |
| 3,535,590 | A | 10/1970 | Mayer | |
| 3,712,222 | A | 1/1973 | Richardson et al. | |
| 3,803,374 | A | 4/1974 | Delgendre et al. | |
| 4,045,762 | A | 8/1977 | Foulkes | |
| 4,176,385 | A | 11/1979 | Dethlefsen | |
| 4,220,087 | A | 9/1980 | Posson | |
| 4,342,978 | A | 8/1982 | Meister | |
| 4,343,242 | A | 8/1982 | Welk | |
| 5,006,679 | A * | 4/1991 | Thornton | 218/1 |
| 5,844,322 | A | 12/1998 | Andersson et al. | |
| 6,305,287 | B1 | 10/2001 | Capers et al. | |
| 2009/0031911 | A1 | 2/2009 | Kellett et al. | |

FOREIGN PATENT DOCUMENTS

| | | |
|---|---|---|
| DE | 26 54 441 A1 | 5/1978 |
| DE | 27 34 872 A1 | 2/1979 |
| DE | 30 20 957 A1 | 12/1981 |

(Continued)

OTHER PUBLICATIONS

International Search Report (PCT/ISA/210) issued on Apr. 12, 2011, by European Patent Office as the International Searching Authority for International Application No. PCT/EP2010/005727.

(Continued)

*Primary Examiner* — Jared Fureman
*Assistant Examiner* — Kevin J Comber
(74) *Attorney, Agent, or Firm* — Buchanan Ingersoll & Rooney PC

(57) ABSTRACT

A low-, medium-, or high-voltage switching device includes a chemical charge unit for actuate closing and/or opening of electric contacts, and a fuze- or ignition cable with chemical charge material to ignite the chemical charge. In order to reach an effective galvanic separation, the chemical charge material of the fuze-cable is electrically insulating, at least in the status before ignition, and at least along a part of its length, in order to cause or effectuate a voltage potential separation between a definite low, medium or high-voltage level and an earth level.

31 Claims, 3 Drawing Sheets

(56) References Cited

FOREIGN PATENT DOCUMENTS

| | | | |
|---|---|---|---|
| DE | 82 08 516 | U1 | 7/1982 |
| DE | 215 663 | A1 | 11/1984 |
| DE | 102 54 497 | B3 | 6/2004 |
| EP | 1 764 817 | A1 | 3/2007 |
| FR | 1 375 374 | A | 10/1964 |
| GB | 1 366 014 | A | 9/1974 |
| WO | WO 2007/095303 | A2 | 8/2007 |
| WO | WO 2009/017880 | A2 | 2/2009 |

OTHER PUBLICATIONS

Written Opinion (PCT/ISA/237) issued on Apr. 12, 2011, by European Patent Office as the International Searching Authority for International Application No. PCT/EP2010/005727.

* cited by examiner

LOW-, MEDIUM-, OR HIGH-VOLTAGE SWITCHING DEVICE WITH CHEMICAL CHARGE MEANS

RELATED APPLICATIONS

This application claims priority as a continuation application under 35 U.S.C. §120 to PCT/EP2010/005727, which was filed as an International Application on Sep. 17, 2010 designating the U.S., and which claims priority to European Application 09011839.9 filed in Europe on Sep. 17, 2009. The entire contents of these applications are hereby incorporated by reference in their entireties.

FIELD

The present disclosure relates to a low-, medium-, or high-voltage switching device with chemical charge means. More particularly, the present disclosure relates to a a low-, medium-, or high-voltage switching device having chemical charge means for actuate closing and/or opening of the electric contacts, and a fuze- or ignition cable with chemical charge material in order to ignite the chemical charge.

BACKGROUND INFORMATION

Gas charge driven switching devices for medium voltage use are well known.

An example of such a switchgear is disclosed in the DE 26 54 441 A1. The actuator of the switchgear is actuated by a gas charge capsule. Several capsules are deposited in a magazine. In this known solution, the chemical charge is not located directly on the contact rod.

Thus, if several mechanical means are implemented between the load transmission and the contact rods, mechanical play is introduced into the actuation movement.

Because of this, the gas charge has to be positioned as near as possible to the contact or the contact rod, which has to be actuated.

However, the chemical charge is located near the contacts or the contact actuators and especially in case of arrangement in series, those parts are under high voltage potential. To ignite this chemical charge, a signal cable has to be used. As a result, the electrical contact to the chemical charge is on high voltage potential. The other side of the cable has to be managed electrically in such a way that the ignition system or the cable, or whatever component is used, should isolate between the different voltage potentials and/or the ground potential, in order to produce high security for the operation of this switch gear. Thus, there is a need to have an insulated part which is carrying the electrical power from one or earth potential or ground potential to low, medium or high voltage potential. A known technique of handling this problem is to install a transformer between earth potential and higher voltage level. By installing a special transformator, it is possible to produce a galvanic barrier for insolating these two electric levels.

SUMMARY

An exemplary embodiment of the present disclosure provides a low-, medium-, or high-voltage switching device which includes chemical charge means for actuate closing and/or opening of electric contacts. The exemplary switching device also includes a fuze- or ignition cable with chemical charge material to ignite a chemical charge. The chemical charge material of the fuze-cable is electrically insulating, at least in the status before ignition, and at least along a part of its length, to cause or effectuate a voltage potential separation between definite a low, medium or high-voltage level and an earth level.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
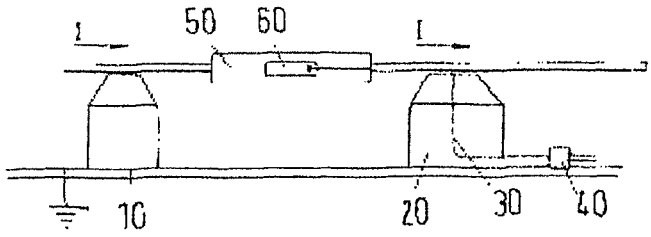
FIG. 1 illustrates an Is-Limiter.

Exemplary embodiments of the present disclosure provide a low-, medium-, or high-voltage switching device which can realize insulating features in a much more effective way in order to use easier ignition means.

For instance, an exemplary embodiment of the present disclosure provides a low-, medium-, or high-voltage switching device which includes chemical charge means (e.g., an actuator) for actuate closing and/or opening of electric contacts. The exemplary switching device also includes a fuze- or ignition cable with chemical charge material to ignite the chemical charge. The chemical charge material of the fuze-cable is electrically insulating, at least in the status before ignition, and at least along a part of its length, to cause or effectuate a voltage potential separation between definite a low, medium or high-voltage level and an earth level.

The aforesaid fuze- or ignition cable may be designated by different synonyms. One of this is detonating cord. This means that the cable itself includes a chemical charge material.

According to the above-described exemplary embodiment of the present disclosure, the chemical charge material of the fuze- or ignition cable is electrically insulating at least in the status before ignition, and at least along a part of its length.

In accordance with an exemplary embodiment, the chemical charge material of the fuze-cable can be surrounded by an electrically insulating coverage. As a result, the cable can be consequently insulating over its full cross section.

In accordance with an exemplary embodiment, a part of the length of the fuze-cable has an enveloping of granular mineral material which is insulating. This embodiment can be used independently from the existence of the above-described insulating coverage. It can be used with high functionality, for example, with or without a further insulating coverage. The granular mineral material causes an adsorption of particles which occur by the ignition, in order to prevent an electrically conductive carbon trace.

In accordance with an exemplary embodiment, the insulating coverage, or the fuze-cable itself can be covered by a ceramic mantle or sheathing, at least along a part of the full length of the fuze-cable. This arrangement prevents carbon traces from being deposed on surrounding elements of the switching device, where such carbon traces may cause conducting paths. Such conducting paths created by the depositing of carbon traces is therefore prevented by this embodiment.

In accordance with an exemplary embodiment, the surface of the chemical charge material and/or the insulating coverage surface is conditioned as hydrophobe. This arrangement also prevents conducting paths from being caused by humidity.

According to an exemplary embodiment using the fuze-cable in the low-, medium-, or high-voltage switching device with means for or with an actuator for closing and/or opening electric contacts, a fuze-cable in low, medium or high voltage switchgears are implemented, in order to operate or actuate opening or closing means of the electrical contacts, by ignition of at least one of the aforesaid fuze-cables.

In accordance with an exemplary embodiment, the fuze-cable can be ignited by a small chemical charge driven igniter.

In accordance with an exemplary embodiment, the fuze-cable can be ignited by a disturbing light arc or another thermal source which occurs in case of a fault, or by a sensor which is sensitive on the light arc or other thermal source, in order to operate the opening or the closing of the aforesaid electric contacts. In the use of such a defined fuze-cable, no further igniting or sensor means are necessary to operate the opening or closing of the contacts.

For a multi-phase arrangement, several fuze-cables may be needed. In this case, the fuze-cables are interconnected over an ignition distributor.

In accordance with an exemplary embodiment, the ignition-means for igniting the fuze-cable can be electrically on ground level, and the chemical charge of the actuator means of the contacts can be on a high voltage level, so that the fuze-cable is arranged between the electrical ground level and the high voltage level.

In accordance with an exemplary embodiment, a separate chemical charge cable and/or fuze-cable can be arranged for each interrupter of a multi-phase switching device.

Accordingly, a first igniter can be ignited by a chemical charge and send the ignition pulse to a distributor, which distributes the ignition to several (e.g., three) further fuze-cables, which are connected to the chemical charge of three interrupters for a three-phase switching device.

Furthermore, according to an exemplary embodiment, the fuze-cable can have an ignition end which is located in the switchgear or a corresponding environment near a place, where a light-arc or another thermal fault source is expected, in order to ignite the fuze-cable.

In accordance with an exemplary embodiment, the switchgear can have a short circuit, for example an arc eliminator device, in which the contacts will be closed by operation of closing means by at least one chemical charge, which is ignited by a pre-ignited fuze-cable, in order to make a short circuit to another voltage potential or to ground voltage potential.

In accordance with an exemplary embodiment, the switchgear includes an interrupter in which the contacts are opened by chemical charge, which is ignited by a pre-ignited fuze-cable, in order to open an electric circuit.

In order to use the fuze-cable as a signal element as well as the chemical charge function at the operation means, according to an exemplary embodiment, one end of the fuze-cable can be rolled or basically arranged into a closed compression room, in which a piston corresponds mechanically with the opening or shutting means of the contacts.

In accordance with an exemplary embodiment, the fuze cable can be arranged in a meander form, in order to lengthen the igniting path and to support enough energy for the needed mechanical operation.

In accordance with an exemplary embodiment, the fuze-cable meander can be arranged on a ceramic of plastic support.

Accordingly, exemplary embodiments of the present disclosure provide that the chemical charge is ignited by a chemical charge cable which includes or is filled with the chemical charge material and in which the chemical charge of the cable is an electrically insulating charge material. According to this arrangement, the ignition cable itself is an insulating part. The ignition signal will therefore not be transmitted electrically by electrical conduction but it is transmitted by a chemical charge signal which is transmitted by the fuze-cable.

No transformer or similar component is needed to insulate between different potentials or between the high voltage and the earth potential.

As in known techniques, a transformer which transforms the power potential from one voltage potential or from earth potential to an another voltage potential or to a higher voltage level may be installed. However, exemplary embodiments of the present disclosure provide for the use of a chemical charge cable based on the principle of using a fuze-cable to transfer the needed ignition energy to the chemical charge or the micro gas generator. An advantage of this arrangement is that the cable is in new condition insulated between high voltage and earth or between different potentials, if needed. Furthermore, after igniting, the fuze-cable has a burning velocity in the range of 7,000 to 10,000 meters per second (m/s), for example. In some cases, it can be reduced down to more than 700 m/s. Thus, in the case of relatively short distances, it can also guarantee very short reaction times for actuating the chemical charge for switching the main interrupter. By this high burning velocity, there is no functional loss between an electrically given signal for ignition and in this case a chemical signal, in correspondence with the fact of 50/60 Hertz energy networks, for example.

FIG. 1 shows a classical Is-limiter. If the cable is burning fast enough and the residual channel will be dielectric stiff (after burning), the ignition of the chemical charge can be realized by using this system, and the electrical insulation to one or to earth is also given. Accordingly, FIG. 1 shows only the principle of the galvanic isolation between the two parts 10 and 20. The side of the cable near to the insulating part 10 carries a current to a bridge or interruption part 50 in which a chemical charge 60 is located. The chemical charge 60 is ignited by the incoming current on the side of position near the insulating part 10. The other side near the insulating part 20 is already on medium voltage potential, or low, or high voltage potential. Thus, after the chemical charge 60, there is the fuze-cable, which is electrically insulating itself. It will be ignited by the chemical charge or the pre-charge 60, so that the signal will burn along the fuze-cable 30 up to the ignition cartridge 40, which is located near or in the switch gear near the contacts, which has to be opened or closed.

Figure 2:
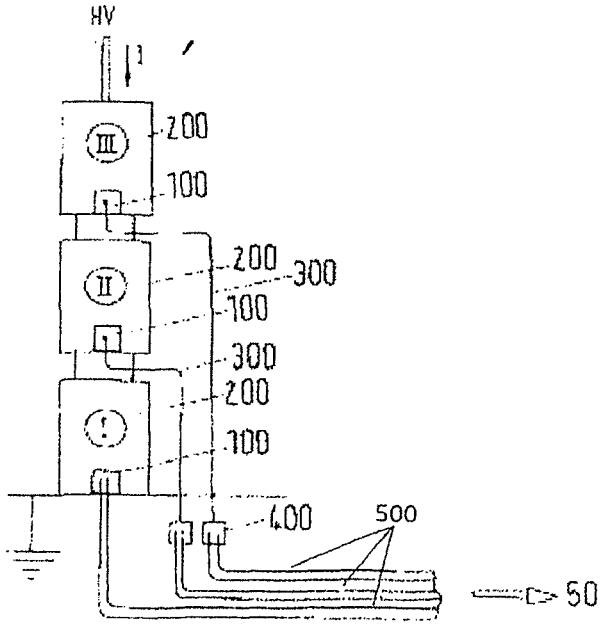
FIG. 2 illustrates an arc-eliminator according to an exemplary embodiment of the present disclosure.

FIG. 2 shows a classical arc eliminator according to an exemplary embodiment of the present disclosure. To ignite the main charge from one or from high voltage potential the chemical charge cable can be used. In new condition, the cable will be stiff enough from the dielectric point of view, between the one potential or high voltage potential and another potential or to the earth potential. In the case of igniting the main charge on one or the high voltage potential, this cable can be burned off. After igniting the fuze-cable, the burning velocity of the cable is at the range between 7,000 to 10,000 meters per second (or in some cases it can be reduced down to more than 700 m/s), for example, which will be fast enough to ignite one or more arc eliminators, which are arranged in series. Thus, as illustrated in FIG. 2, micro gas generators 100 are implemented in several arc eliminators 200, which are arranged in series. Thus, each micro gas generator 100 ignites itself a fuze-cable 300 based on a chemical charge in the sense of the above mentioned disclosure. As a result, the fuze-cables 300 are ending in ignition cartridges 400 concerning to the cables 500 for an electronic device 50.

Figure 3:
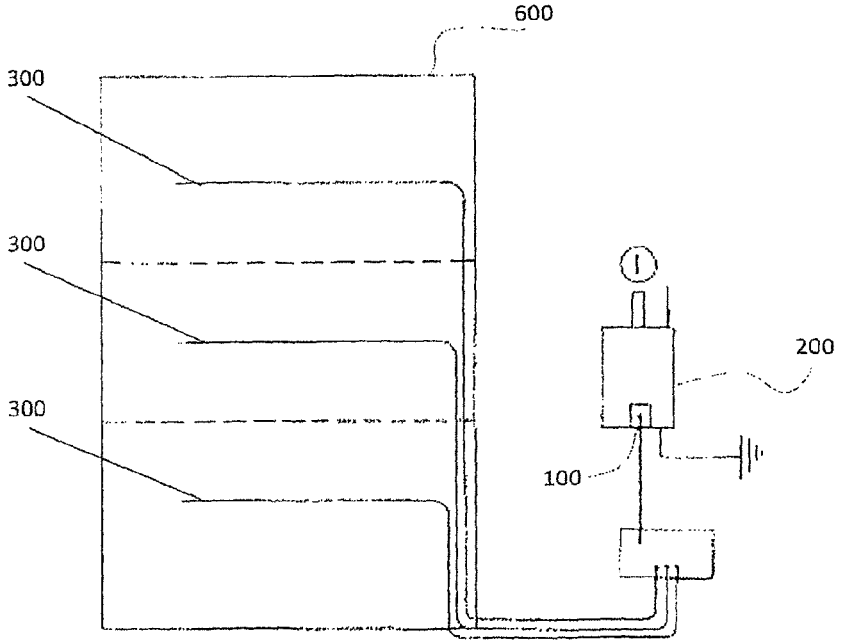
FIG. 3 illustrates a configuration for fast detection of a burning arc according to an exemplary embodiment of the present disclosure.

FIG. 3 shows the detection of burning arc in a switchgear according to an exemplary embodiment of the present disclosure. In this case, the fuze-cable 300 will be arranged in the different compartments of a switchgear 600, the arc can ignite the detection cable (fuze-cable). By carrying the burn within the burning cable, the arc eliminator can be directly ignited from the cable. Accordingly, in this arrangement, or in case there is no electronic device necessary for detection issues, the energy is carried from the micro gas generator 100 to ignite arc eliminator 200. In fact, the arc eliminator works directly with the ignited and burning cable as shown in FIG. 3.

Figure 4:
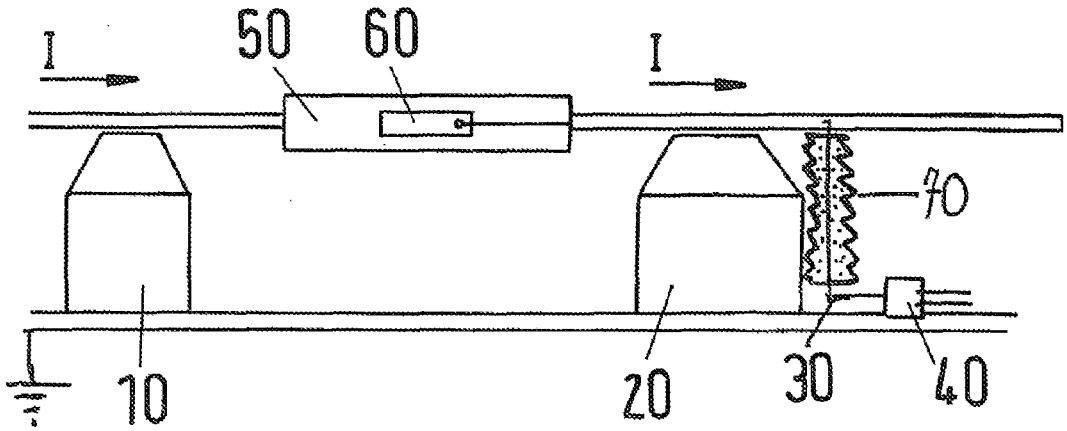
FIG. 4 shows an exemplary embodiment in which at least a part of the length of the fuze-cable is arranged in a ceramic housing.

FIG. 4 shows an exemplary embodiment in which at least a part of the length of the fuze-cable is arranged in a ceramic housing, in order to prevent a deposition of conductive carbon material between one or high voltage potential and low potential parts of the switching device. FIG. 4 therefore shows this embodiment in the use of an Is-Limiter. The fuze-cable is arranged in the ceramic housing 70 which could be filled with sand.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A low-, medium-, or high-voltage switching device comprising:

chemical charge means for actuate closing and/or opening of electric contacts; and a fuze- or ignition cable including chemical charge material to ignite a chemical charge, wherein the chemical charge material of the fuze-cable is electrically insulating at least in a status before ignition, and at least along a part of its length, to cause or effectuate a voltage potential separation between a definite low, medium or high-voltage level and an earth level.

2. The switching device according to claim 1, comprising:

an electrically insulating coverage surrounding the chemical charge material of the fuze-cable.

3. The switching device according to claim 2, wherein a part of the length of the fuze-cable has an enveloping of granular mineral material which is insulating.

4. The switching device according to claim 3, wherein at least one of the insulating coverage and the fuze-cable itself is covered by one of a ceramic mantle and sheathing, at least along a part of a full length of the fuze-cable.

5. The switching device according to claim 3, wherein a surface of at least one of the chemical charge material and an insulating coverage surface is conditioned as a hydrophobe.

6. The switching device according to claim 3, wherein the fuze cable has at least one necking along its length.

7. The switching device according to claim 3, comprising:

means for closing and/or opening electric contacts, wherein the fuze- or ignition cable is comprised in at least one low, medium or high voltage switching device to at least one of operate and actuate opening or closing means of the electrical contacts, by ignition of at least one of the fuze- or ignition cable.

8. The switching device according to claim 7, wherein the fuze- or ignition cable is configured to be ignited by a small chemical charge driven igniter.

9. The switching device according to claim 8, wherein the fuze- or ignition cable is configured to be ignited by at least one of (i) a disturbing light arc or another thermal source which occurs in case of a fault, and (ii) a sensor which is sensitive on the light arc or another thermal source to operate the opening or the closing of the electric contacts.

10. The switching device according to claim 9, comprising:

ignition-means for igniting the fuze- or ignition cable, the ignition means being electrically on ground level, and wherein the chemical charge of the actuator means of the contacts is on high voltage level so that the fuze- or ignition cable is arranged between an electrical ground level and a high voltage level.

11. The switching device according to claim 9, comprising:

at least one of a separate chemical charge cable and fuze- or ignition cable for each interrupter of a multi phase switching device.

12. The switching device according to claim 9, comprising:

a first igniter configured to be ignited by a chemical charge and send the ignition pulse to a distributor, which is configured to distribute the ignition to a plurality of additional fuze- or ignition cables which are connected to the chemical charge of three interrupters of a three-phase switching device.

13. The switching device according to claim 8, wherein in case of a plurality of fuze- or ignition cables, the fuze- or ignition cables are interconnected over an ignition distributor.

14. The switching device according to claim 7, wherein the fuze- or ignition cable includes an ignition end which is located in one of the switchgear and a corresponding environment near a place in which a light-arc or another thermal fault source is expected, to ignite the fuze- or ignition cable.

15. The switching device according to claim 1, wherein a part of the length of the fuze-cable has an enveloping of granular mineral material which is insulating.

16. The switching device according to claim 15, wherein at least one of the insulating coverage and the fuze-cable itself is covered by one of a ceramic mantle and sheathing, at least along a part of a full length of the fuze-cable.

17. The switching device according to claim 1, wherein a surface of at least one of the chemical charge material and an insulating coverage surface is conditioned as a hydrophobe.

18. The switching device according to claim 1, wherein the fuze cable has at least one necking along its length.

19. The switching device according to claim 1, comprising:

means for closing and/or opening electric contacts, wherein the fuze- or ignition cable is comprised in at least one low, medium or high voltage switching device to at least one of operate and actuate opening or closing means of the electrical contacts, by ignition of at least one of the fuze- or ignition cable.

20. The switching device according to claim 19, wherein the fuze- or ignition cable is configured to be ignited by a small chemical charge driven igniter.

21. The switching device according to claim 19, wherein the fuze- or ignition cable is configured to be ignited by at least one of (i) a disturbing light arc or another thermal source which occurs in case of a fault, and (ii) a sensor which is sensitive on the light arc or another thermal source to operate the opening or the closing of the electric contacts.

22. The switching device according to claim 19, wherein in case of a plurality of fuze- or ignition cables, the fuze- or ignition cables are interconnected over an ignition distributor.

23. The switching device according to claim 22, comprising:

ignition-means for igniting the fuze- or ignition cable, the ignition means being electrically on ground level, and wherein the chemical charge of the actuator means of the contacts is on high voltage level so that the fuze- or ignition cable is arranged between an electrical ground level and a high voltage level.

24. The switching device according to claim 19, wherein the fuze- or ignition cable includes an ignition end which is located in one of the switchgear and a corresponding environment near a place in which a light-arc or another thermal fault source is expected, to ignite the fuze- or ignition cable.

25. The switching device according to claim 1, comprising:

at least one of a separate chemical charge cable and fuze- or ignition cable for each interrupter of a multi phase switching device.

26. The switching device according to claim 1, comprising:

a first igniter configured to be ignited by a chemical charge and send the ignition pulse to a distributor, which is configured to distribute the ignition to a plurality of additional fuze- or ignition cables which are connected to the chemical charge of three interrupters of a three-phase switching device.

27. The switching device according to claim 1, comprising:

a short circuit device in which the contacts are configured to be closed by operation of a closing means by at least one chemical charge, which is configured to be ignited by a pre-ignited fuze- or ignition cable to make a short-circuit to ground voltage level.

28. The switching device according to claim 1, comprising:

an interrupter in which the contacts are opened by chemical charge, which is configured to be ignited by a pre-ignited fuze- or ignition cable to open an electric circuit.

29. The switching device according to claim 1, wherein one end of the fuze- or ignition cable is configured to be rolled into a closed compression room in which a piston corresponds mechanically with an opening or shutting means of the contacts.

30. The switching device according to claim 1, wherein the fuze cable is arranged in a meander form to lengthen a path of ignition.

31. The switching device according to claim 30, wherein the fuze cable meander is arranged on one of a ceramic support and a plastic support.

* * * * *